United States Patent [19]

Asai et al.

[11] Patent Number: 5,061,095

[45] Date of Patent: Oct. 29, 1991

[54] PRINTER FOR PRINTING ON MULTIPLE TYPES OF PRINTING SHEETS

[75] Inventors: Naoki Asai; Masahiro Minowa; Choji Morozumi, all of Nagano, Japan

[73] Assignee: Seiko Epson Corporation, Tokyo, Japan

[21] Appl. No.: 611,637

[22] Filed: Nov. 13, 1990

[30] Foreign Application Priority Data

Nov. 14, 1989 [JP] Japan ..... 1-295535

[51] Int. Cl.[5] ..... B41J 11/50

[52] U.S. Cl. ..... 400/605; 400/56; 400/636; 400/708

[58] Field of Search ..... 400/605, 611, 636, 708, 400/56–58, 586, 595, 599, 600, 600.1, 600.2, 600.3, 607, 608.1, 642

[56] References Cited

U.S. PATENT DOCUMENTS

| | | | |
|---|---|---|---|
| 4,173,420 | 11/1979 | Okabe | 400/608.1 |
| 4,422,782 | 12/1983 | Lawter et al. | 400/636 |
| 4,448,559 | 5/1984 | Matsuda et al. | 400/600.3 |
| 4,702,629 | 10/1987 | Hamano et al. | 400/56 |
| 4,743,129 | 5/1988 | Keryhuel et al. | 400/708 |
| 4,927,277 | 5/1990 | Niikawa | 400/605 |
| 4,929,104 | 5/1990 | Youoi | 400/605 |
| 4,936,694 | 6/1990 | Yasuoka | 400/605 |

FOREIGN PATENT DOCUMENTS

| | | | |
|---|---|---|---|
| 0246450 | 6/1987 | Fed. Rep. of Germany | 400/605 |
| 0149467 | 7/1987 | Japan | 400/611 |
| 0078774 | 4/1988 | Japan | 400/605 |

*Primary Examiner*—Eugene H. Eickholt

*Attorney, Agent, or Firm*—Sughrue, Mion, Zinn, Macpeak & Seas

[57] ABSTRACT

A printer for printing on at least two types of recording sheet using a single print head arranged at a single printing section. The printer includes a first recording sheet forwarding path, a second sheet forwarding path, a first recording sheet forwarding mechanism, a second recording sheet forwarding mechanism, a printing section opening/closing mechanism, a first recording sheet path opening/closing mechanism, a second recording sheet path opening/closing mechanism, a single recording sheet detector, and a recording sheet blocking mechanism.

9 Claims, 11 Drawing Sheets

PRINTER FOR PRINTING ON MULTIPLE TYPES OF PRINTING SHEETS

BACKGROUND OF THE INVENTION

The invention pertains to printers, and more particularly to the construction of a printer particularly suited for POS/ECR applications.

Conventional printers for printing on slips, which is one type of cut sheet, must generally have a flat recording sheet guide of large area because slips comes in various sizes and may contain many printing lines. Few such printers (generally called "slip printers") allow the use of a rolled sheet.

A validation sheet, which also is a type of cut sheet, is generally available in a regular size. However, validation sheets are multiple-layer sheets, that is, each validation sheet includes plural copying sheets behind the front or top sheet. Conventional printers dedicated to rolled sheet printing, on the other hand, have not been able to accommodate validation sheets along their recording sheet paths.

FIG. 11 is a schematic diagram showing a slip printer designed for slip printing, in which reference numeral 401 designates a print head; 12, a slip sheet, which is a recording sheet; 404 and 405, sheet forwarding rollers for forwarding the slip sheet 12 while interposing it therebetween; 403, a positioning member for positioning the slip sheet before starting to print; and 402*a* and 402*b*, a pair of recording sheet detectors. As shown in FIG. 11, it is common to provide two detectors, one 402*a* for detecting the head end of the slip sheet 12, and the other 402*b* for detecting its tail end to inform of a print limit.

FIG. 12 is a schematic diagram showing a printer designed for validation sheet printing, in which reference numeral 13 designates a validation sheet; and 406, a sheet guide and positioning member. As shown in FIG. 12, this printer is provided with a recording sheet detector 402*c* for detecting the tail end of the validation sheet 13.

In FIGS. 13 and 14 are block diagrams of a conventional recording sheet control system. With this system, the means for forwarding the continuous sheets such as journal sheets and receipts the means for forwarding cut sheets such as slips are driven by separate drive sources and separate clutch means 411 and 412. Some conventional systems control a single drive source by switching the drive force using drive force switching means 413 between cut sheet printing and rolled sheet printing.

Recently, POS/ECR printers capable of handling various types of recording sheets used in POS markets have been called for. However, an attempt to integrate the conventional slip printer and validation printer, and even a rolled sheet printer, together into a POS/ECR printer requires that a printing section be provided separately for each type of printing operation or a number of recording sheet detectors be employed, thereby making such a printer not only expensive but also large in structure.

In addition, ordinary validation sheets, which are thick since a number of copying sheets are attached, are susceptible to separation and jamming as they pass along the long recording sheet forwarding path, which is troublesome.

Moreover, the conventional recording sheet forwarding paths, each driven by a separate drive source and a separate clutch, require an expensive and complicated control system involving a large number of parts. A single drive system such as shown in FIG. 14 employs a gear switching mechanism as the drive force switching means. However, to meet the latest demand no only for independent operation of both slip printing and rolled sheet printing but also for their simultaneous operation in which the slip printing content is simultaneously printed on a rolled sheet as a journal for security purposes (hereinafter referred to as "security slip"), the conventional printer does not provide the necessary functions.

SUMMARY OF THE INVENTION

An object of the invention therefore is to provide a simply constructed and highly reliable printer capable of printing various types of recording sheets with an integrated printing section, inexpensive and space-saving print mechanisms, and a means and method for optimally controlling the print mechanisms.

Another object of the invention is to provide a printer mechanism capable not only of efficiently switching between cut sheet printing and continuous sheet printing, but also of simultaneously printing a cut sheet printing content on a continuous sheet whenever necessary, and a method of controlling such a printer mechanism.

To achieve the above objects, a first aspect of the invention provides a printer capable of printing at least two types of recording sheets in a printing section having only one print head. This printer comprises a first recording sheet forwarding path for a first recording sheet to be printed by being inserted from below the printing section, or from an inlet side thereof in a recording sheet forwarding direction; a second recording sheet forwarding path for a second recording sheet to be printed by being inserted from above the printing section, or from a discharge side thereof in the recording sheet forwarding direction; a printing section opening/closing mechanism that can be electrically driven to change the clearance between the print head and a platen confronting the print head; a first recording sheet forwarding mechanism disposed within the first recording sheet forwarding path; a first sheet forwarding section opening/closing mechanism that can be electrically driven to open and close the first recording sheet forwarding path by biasing and releasing a recording sheet forwarding drive section disposed within the first recording sheet forwarding mechanism toward and away from the first recording sheet; a second recording sheet forwarding mechanism, disposed at a recording sheet path shared in common by both the first and second recording sheets, for forwarding both the first and second recording sheets; a second sheet forwarding section opening/closing mechanism that can be electrically driven to open and close the recording sheet forwarding path by biasing and releasing a recording sheet forwarding drive section disposed within the second recording sheet forwarding mechanism toward and from the first or second recording sheet; recording sheet detection means, disposed adjacent to a point at which the first and second recording sheet forwarding paths meet, for detecting the first or second recording sheet; and a sheet path blocking mechanism that can be electrically driven to block the first or second recording sheet forwarding path, the sheet path blocking mechanism being disposed between the recording sheet detection means and the printing section.

A second aspect of the invention provides a printer that comprises means for controlling the operation of the printing section opening/closing mechanism, the first and second recording sheet forwarding section opening/closing mechanisms in accordance with the type of recording sheet.

A third aspect of the invention provides a printer that comprises a third recording sheet forwarding path for a third recording sheet which is a continuous recording sheet such as a rolled sheet, in addition to the first and second recording sheets; and a third recording sheet forwarding mechanism for forwarding the third recording sheet. The third recording sheet mechanism is driven by the drive source that drives the first and second recording sheet forwarding mechanisms, and the third recording sheet can also be printed at the printing section.

According to the invention, a slip sheet of relatively large size, which is one type of cut sheet, can be printed after being inserted from the inlet side of the printing section in a recording sheet forwarding direction, while a validation sheet, to which a plurality of copying sheets are generally attached and which is of a fixed size with less printing lines, can be inserted from the discharge side, ensuring that its printing can be performed properly without damaging the attached copying sheets. In addition, an end of the recording sheet can be positioned and detected in accordance with the type of recording sheet, thereby accommodating the need for handling various types of recording sheets with only one printer.

BRIEF DESCRIPTION OF THE DRAWINGS

FIG. 10(*b*) is a view showing the appearance of the mechanism section of the printer according to the invention;

DESCRIPTION OF THE PREFERRED EMBODIMENTS

Preferred embodiments of the invention will now be described with reference to the accompanying drawings.

Figure 10A:
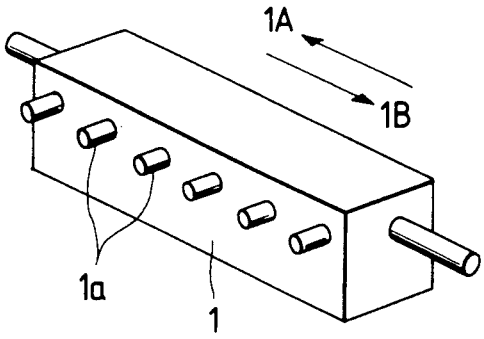
FIG. 10(*a*) is a schematic showing an exemplary structure of a print head to be used in the mechanism section of the printer according to the invention.
Figure 10B:
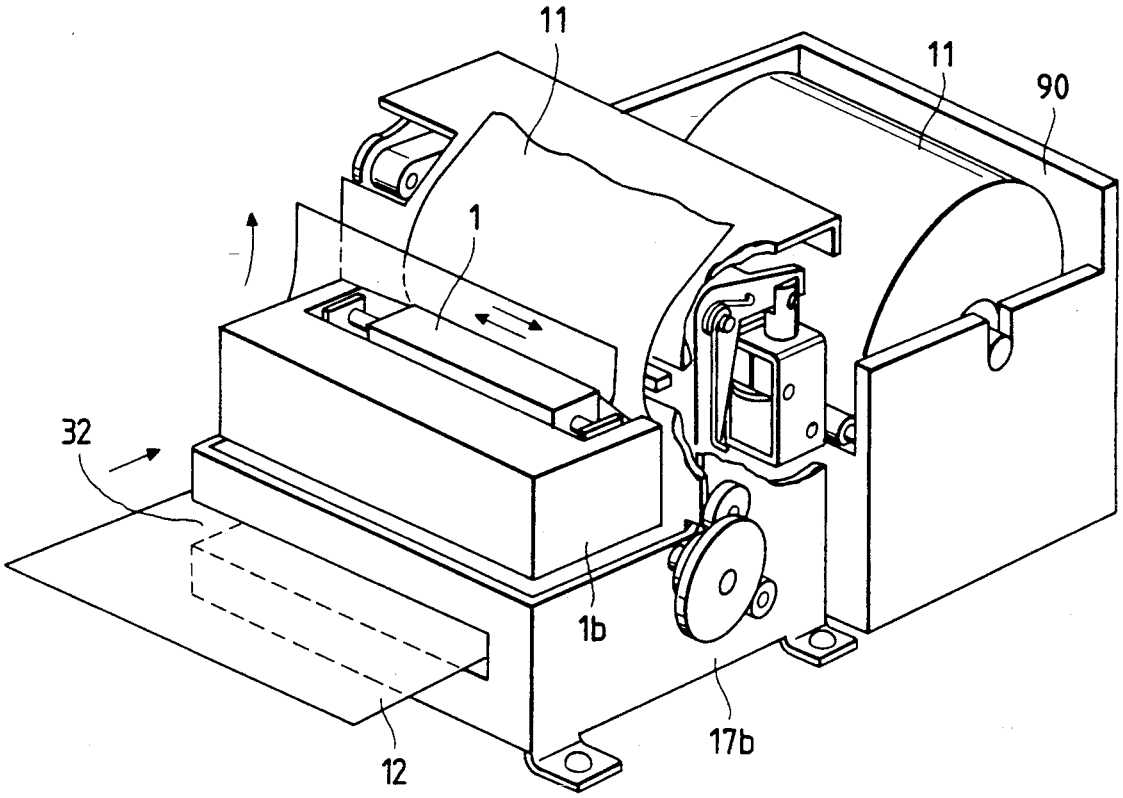
Figure 11:
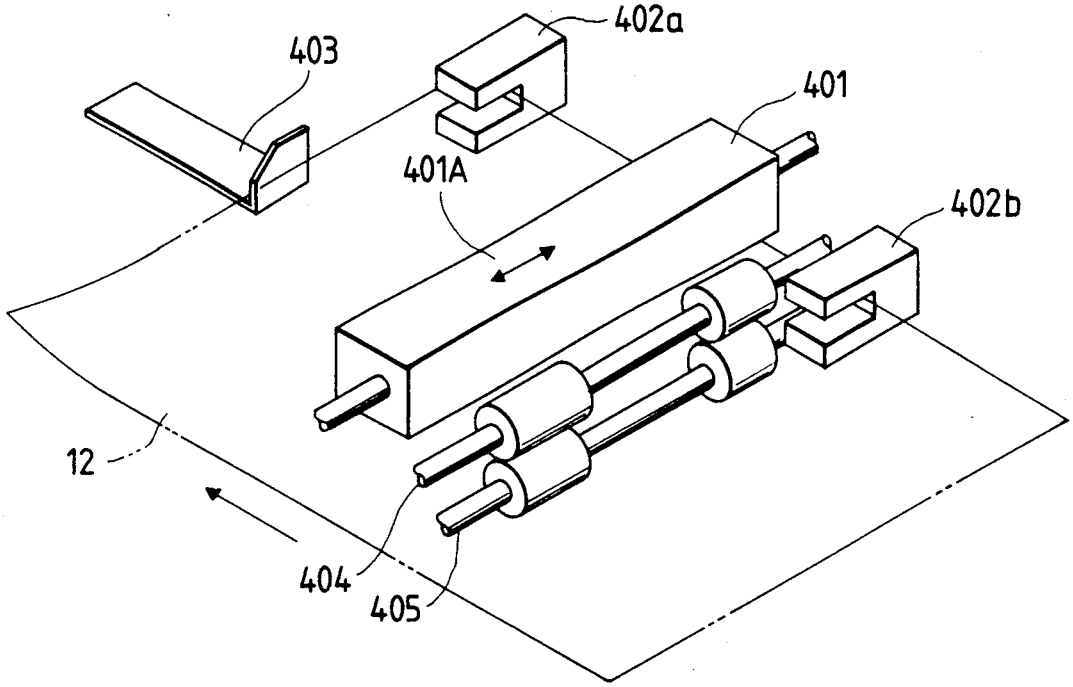
FIG. 11 PRIOR ART
FIGS. 11 and 12 are schematic diagrams each showing a conventional cut sheet printer.
Figure 12:
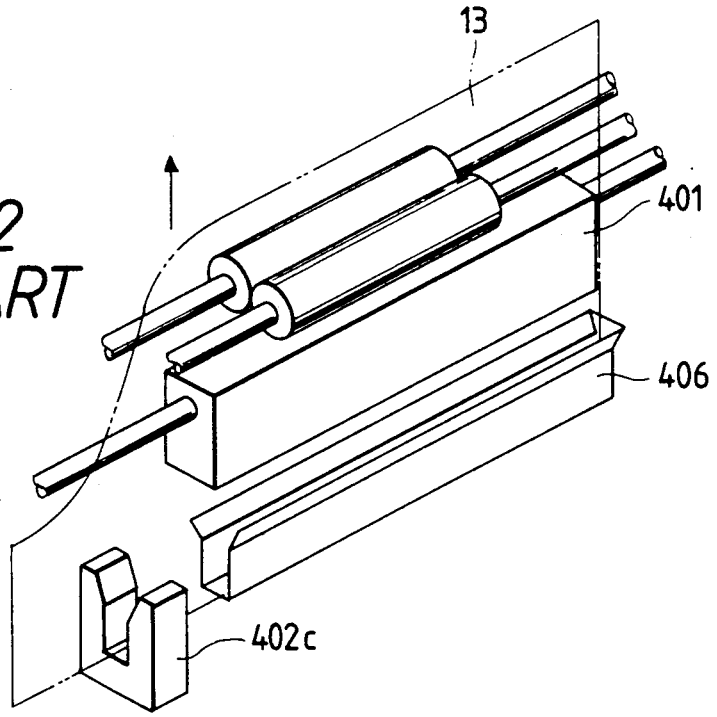
FIG. 12 PRIOR ART
Figure 13:
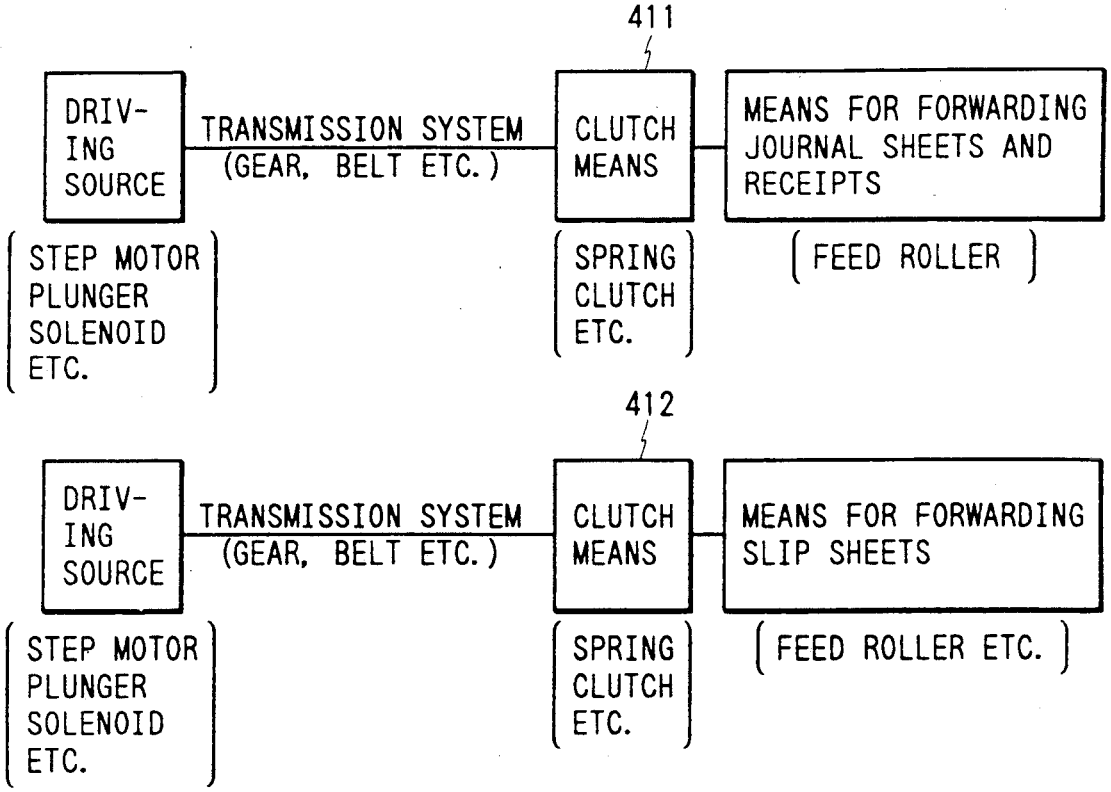
FIG. 13 PRIOR ART
FIGS. 13 and 14 are block diagrams showing conventional recording sheet control systems.
Figure 14:
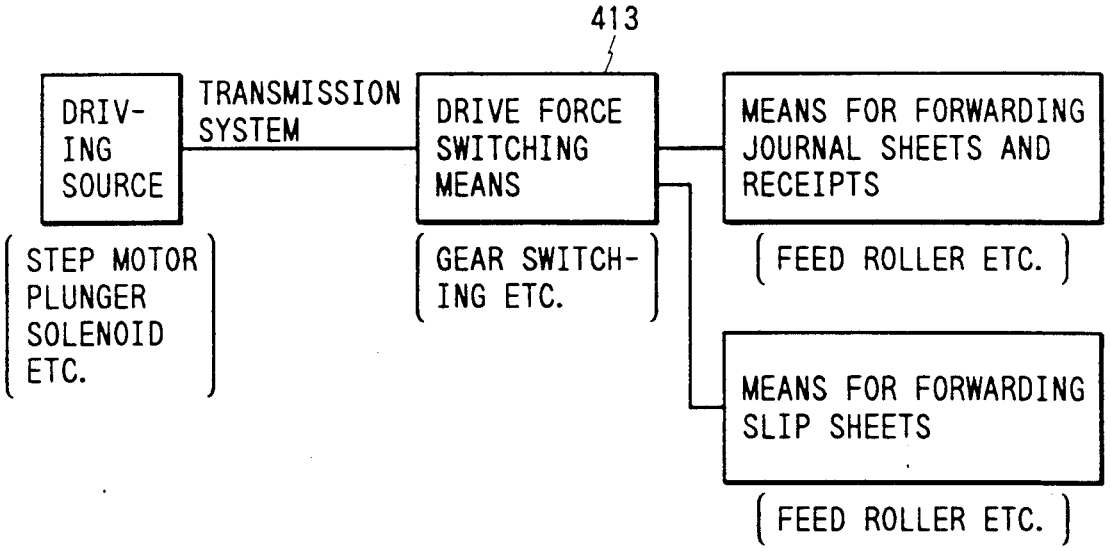
FIG. 14 PRIOR ART

FIG. 10(*a*) is a schematic showing an exemplary structure of a print head to be used in a mechanism section of a printer according to the invention. In the figure, reference numeral 1 designates a print head body, and 1*a*, print wire pins for forming dots. As shown in the figure, a plurality of wire pins 1*a* are horizontally arrayed in a row at a predetermined interval to print characters, symbols, and the like, while shuttling in directions of arrows 1A and 1B.

FIG. 10(*b*) is shows the general appearance of the mechanism section of the printer according to the invention. The printer of the invention has a mechanism section capable of printing on three or more types of recording sheets while horizontally shuttling the print head 1 mounted on the mechanism section. The construction of the printer will be described in detail.

Figure 4A:
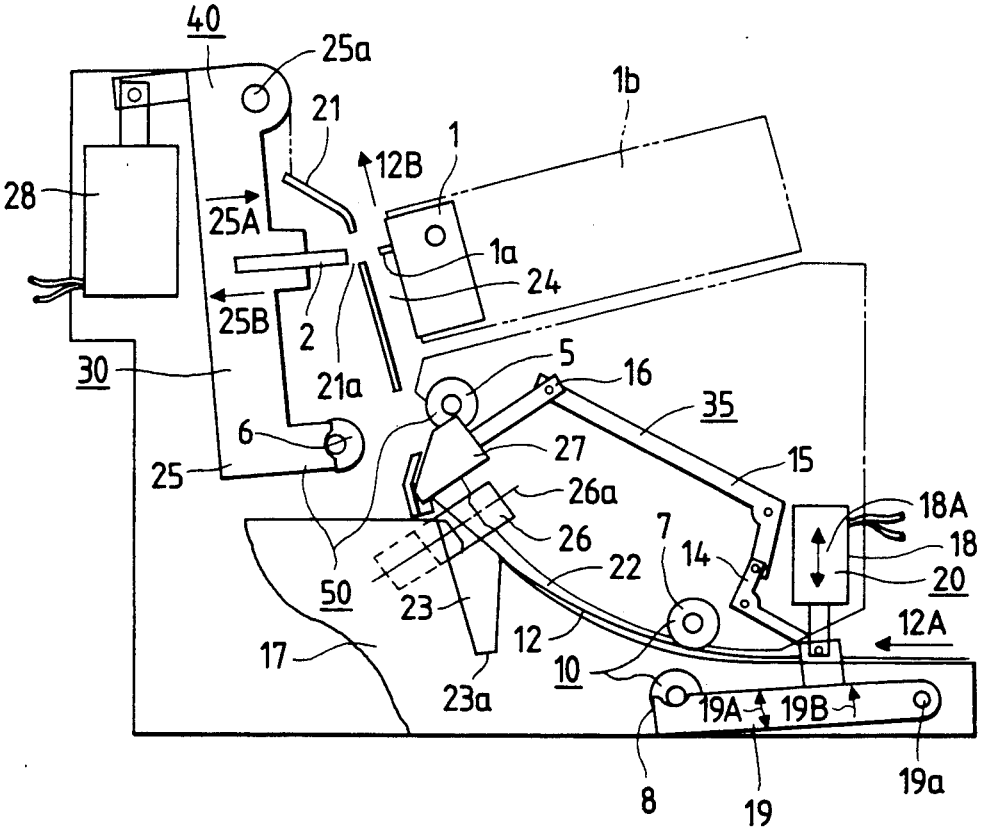
FIGS. 4(*a*) and 4(*b*) and FIGS. 5(*a*) and 5(*b*) are, respectively, schematic diagrams showing the construction of a mechanism section of the printer according to the invention and the operation of respective parts of the mechanism section in accordance with the type of recording sheet.
Figure 4B:
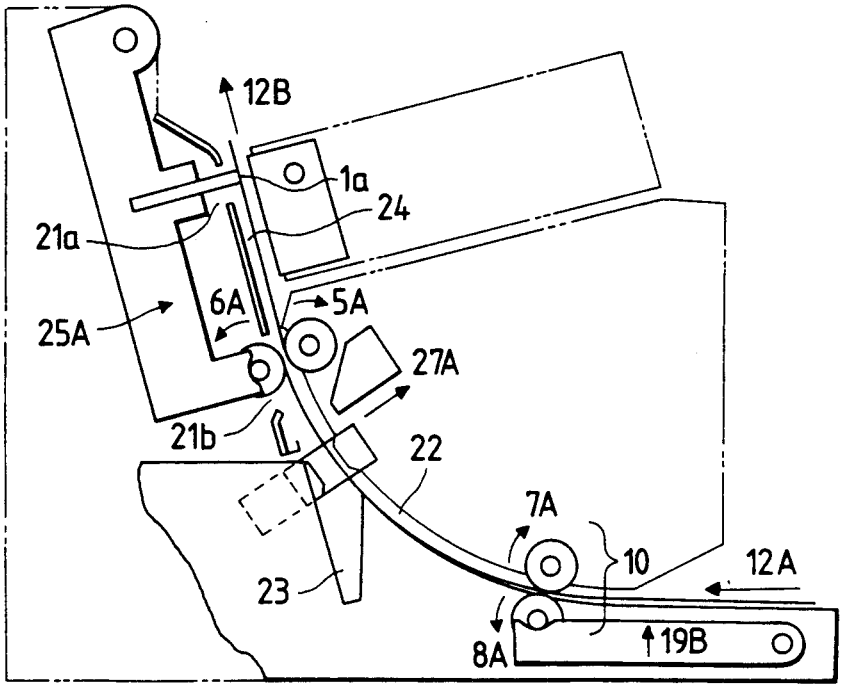
Figure 5A:
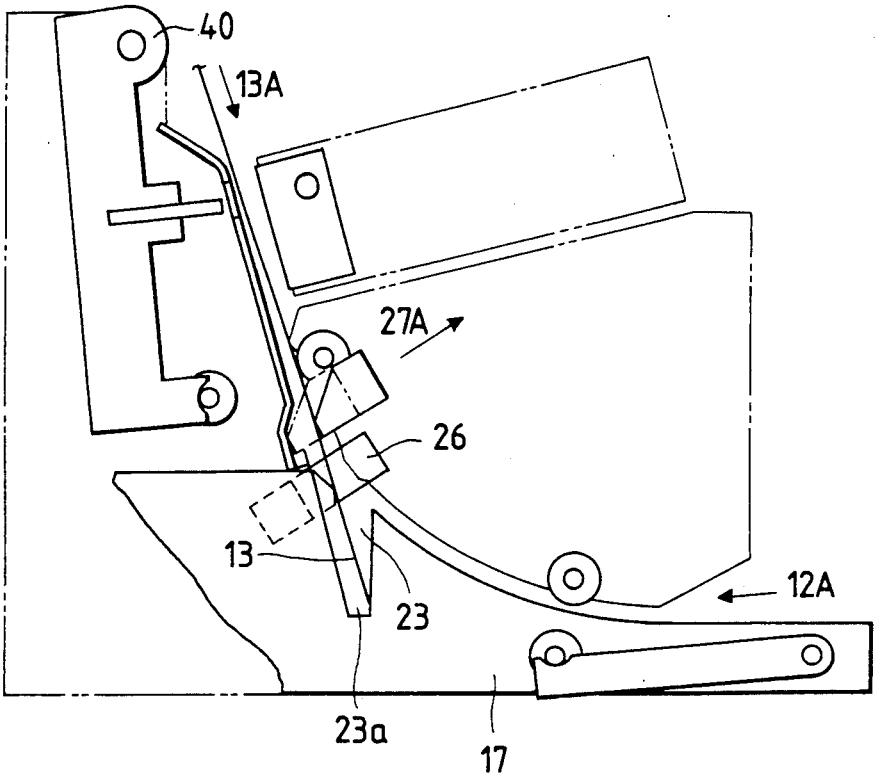
Figure 5B:
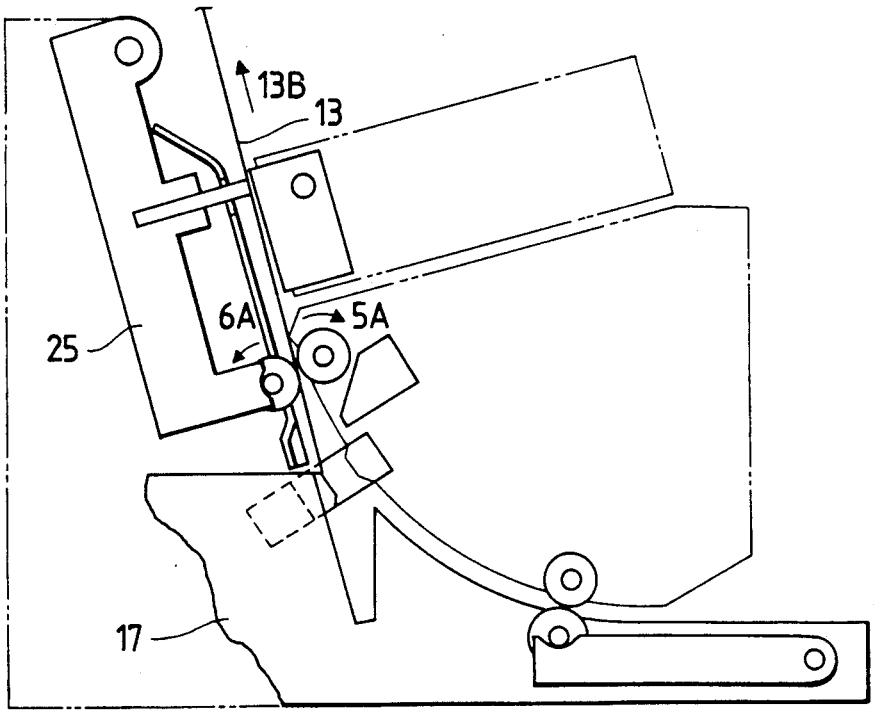

FIGS. 4(*a*) and 4(*b*) and FIGS. 5(*a*) and 5(*b*) are, respectively, schematic diagrams showing the construction of the mechanism section of the printer according to the invention and illustrating the operation of respective parts of the mechanism section in accordance with the type of recording sheet.

FIGS. 4(*a*) and 4(*b*) show the operation of the printer when used as a slip printer. The print head 1, which has a plurality of print elements 1*a* horizontally arrayed in a row, prints on a recording sheet interposed between the printed head 1 and a platen 2 confronting the print head 1 through an ink ribbon (not shown). The print head 1 is of a so-called "shuttle printer" type that shuttles horizontally driven by a motor (not shown) Reference numeral 1b designates a ribbon cassette containing the ink ribbon.

Recording sheet drive rollers 5 are connected to a drive source (not shown) such as a motor through a transmitting system such as gears. Recording sheet biasing rollers 6, disposed at positions opposite the recording sheet drive rollers 5, are rotatably supported by an arm 25. The platen 2 is secured to the arm 25. The arm 25 is arranged so as to be swingable in directions of arrows 25A and 25B around a pivot 25*a* by a plunger 28. The platen 2, the arm 25, and the plunger 28 are main components of a printing section opening/closing mechanism 40. Also, the recording sheet biasing roller 6, the arm 25, and the plunger 28 constitute major elements of a sheet forwarding section opening/closing mechanism 30, while these major elements, together with the recording sheet drive rollers 5, form a cut sheet forwarding mechanism 50. The printing section opening/closing mechanism 40 serves to change the clearance between the print head 1 and the platen 2 of the printing section. The printing section opening/closing mechanism 40 and the sheet forwarding opening/closing mechanism 30 share in common the arm 25 that serves both as a drive source and a drive force transmitting member.

Reference numeral 7 designates a recording sheet drive roller, and 8, a recording sheet biasing roller disposed at a position opposite the recording sheet drive roller 7. The recording sheet biasing roller 8 is supported by an arm 19 and is swingable in directions of arrows 19A around a pivot 19*a* by a plunger 18. The recording sheet drive roller 7, the recording sheet biasing roller 8, the arm 19, and the plunger 18 constitute major elements of a recording sheet forwarding mechanism 10. Also, the plunger 18, the arm 19, and the recording sheet biasing roller 8 constitute a sheet forwarding section opening/closing mechanism 20. Reference numeral 21 designates a recording sheet guide defining a recording sheet forwarding path. This guide 21 includes a notch section 21*a* for allowing the platen 2 to pass therethrough and a notch section 21*b* for allowing the biasing rollers 6 to pass therethrough. Reference numeral 22 designates a recording sheet forwarding path for slip sheets. The path 22 is connected to a recording sheet forwarding path 24 by meeting a recording sheet forwarding path 23 for validation sheets.

The operation of the plunger 18 (in directions of arrows 18A) is transmitted to a foam stopper 27 that blocks the recording sheet paths 22, 23 through cranks 14, 15 and a support member 16 which serves as a dead end stopper for positioning the recording sheet. A sheet path block mechanism 35 is constituted mainly by these elements.

The plungers 18 and 28, each serving as a drive source to provide shuttling movement, may preferably be of such type that a state memory magnet is built in. This is because the preservation of the magnetic state eliminates wasteful dissipation. In this case, a circuit for driving the plungers 18, 28 may be of a bipolar type so that current can flow bidirectionally.

A pair of recording sheet detectors 26 confronting each other are ordinary optical sensors, each having an optical axis 26*a*. The presence of a recording sheet is detected when the optical axis 26*a* is shielded.

Figure 1:
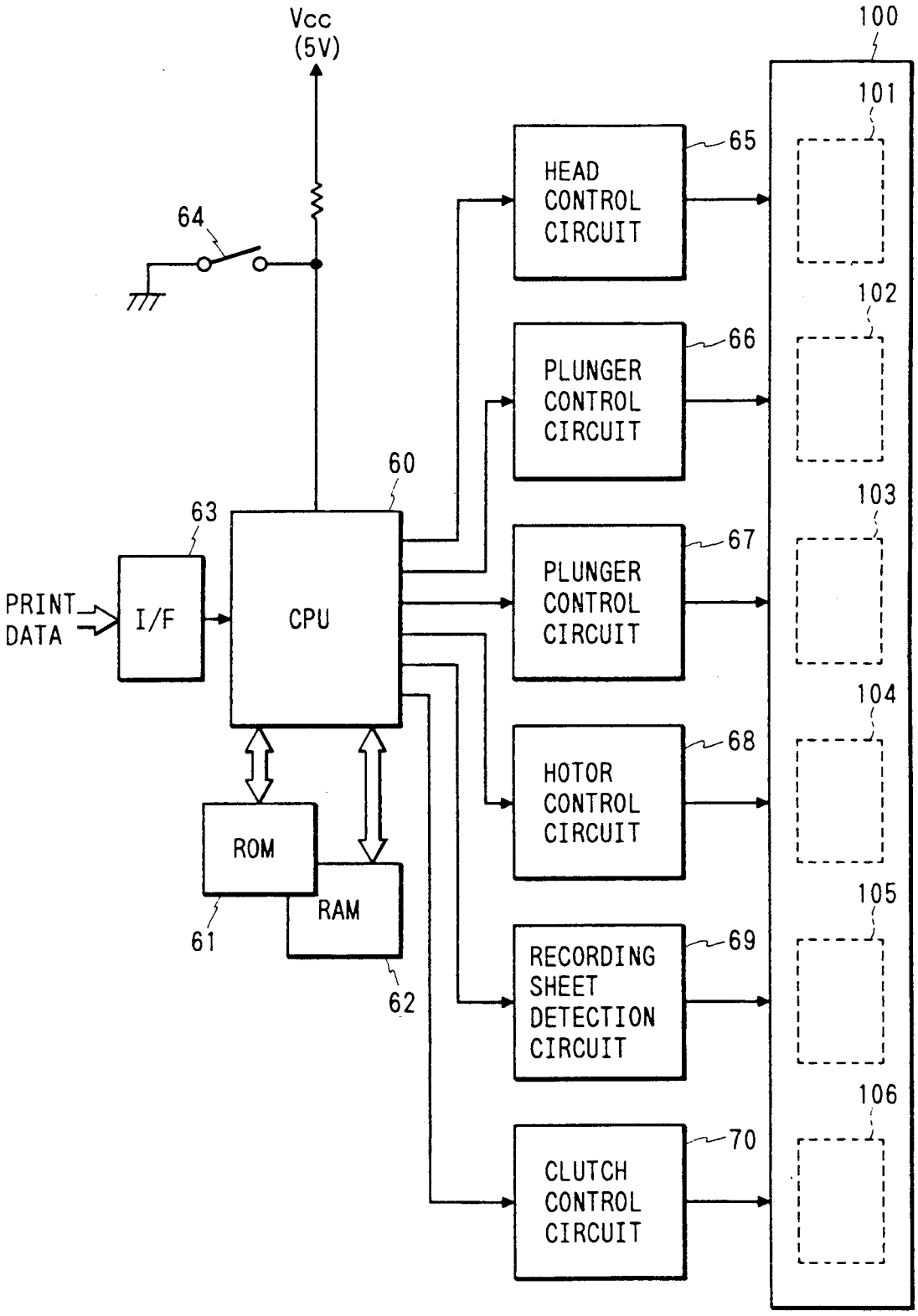
FIG. 1 is a block diagram showing the general construction of control systems of the invention.

A recording sheet 12 such as a slip sheet is printed as it is forwarded along the recording sheet forwarding paths in directions of arrows 12A to 12B. FIG. 1(*a*) illustrates a state in which the recording sheet detectors 26 detect the presence of the recording sheet 12 at the time the recording sheet 12 has been set. The recording sheet 12 can be positioned with the foam stopper 27 as a dead end stopper. Once the recording sheet 12 in slip form has been positioned, the plunger 18 is operated to drive the arm 19 in the direction of arrow 19B, and, as soon as the recording sheet forwarding section is closed, the foam stopper 27 is driven in a direction of arrow 27A to release itself from the recording sheet forwarding path so that the recording sheet 12 can be forwarded. At this time, the printing section opening/closing mechanism 40 is closed by driving it in the direction of arrow 25A.

A stepper motor, as is usually used as a drive source of forwarding recording sheets, is arranged so that the sheet forwarding mechanisms 10, 50 are connected to a single drive source so that they can be operated in synchronism with each other. As the motor (not shown) is rotated, the drive rollers 7, 5 are rotated in directions of arrows 7A and 5A, respectively, while the slip sheet 12 is forwarded by being interposed between the drive rollers 7, 5 and the biasing rollers 8, 6 confronting thereto. Printing of the slip sheet 12 is started after the head end of the slip sheet forwarded up to the printing section at a predetermined speed has reached a predetermined position with respect to the upper portion of the printing section.

FIGS. 5(*a*) and 5(*b*) show the operation of the printer according to the invention when used as a validation printer.

FIG. 5(*a*) shows the state of the printer at the time a validation sheet is being inserted, while FIG. 5(*b*) shows the state where the printer is in operation. Like reference numerals and characters as in FIGS. 4(*a*) and 4(*b*) designate like parts and components, and hence a further description of those elements will be omitted.

A validation sheet is a type of slip whose size is fixed and which has a number of copying sheets attached thereto for validation purposes.

To use the printer as a validation sheet printer, a validation sheet 13 is inserted from the discharge side (or from the top of the printing section) for normal printing as indicated by arrow 13A. The printing section opening/closing mechanism 40 must be opened to set the validation sheet 13. This provides a large clearance at the printing section, thereby allowing easy handling of the validation sheet, which is thick due to the attached copying sheets.

No long recording sheet forwarding paths need be prepared for ordinary validation sheets, the size of which is of the order of 3.5". The recording sheet forwarding path 23 formed by notching a side frame 17 of the printer guides the validation sheet 13 in a direction different from that of the slip sheet 12. The inserted validation sheet 13 is further guided down to arrive at the dead end stopper 23*a* to set its tail end. At this time, the foam stopper 27, being arranged so as to be slidable along the support member 16, will be evacuated in a direction of arrow 27A by the force of the validation sheet 13, thereby not blocking the advance of the validation sheet 13.

A portion of the recording sheet forwarding path between the printing section and the recording sheet detector 26 is shared in common by the slip sheet and the validation sheet. The recording sheet detector 26, which is an ordinary optical sensor, is disposed at a position that allows detection of both the validation sheet 13 inserted as indicated by arrow 13A and the slip sheet 12 inserted as indicated by arrow 12A.

While the opposed type recording sheet detector 26 is used in this embodiment, a reflection type optical detector or a mechanical type detector may also be used for detection of both types of recording sheet.

Upon completion of setting the validation sheet 13, the platen 2 and the biasing rollers 6 evacuated from the recording sheet forwarding path are driven in the direction of arrow 25A by the plunger 28 in a manner similar to that for the slip sheet 12, with the validation sheet 13 being interposed between the drive rollers 5 and the biasing rollers 6. Under this condition, the print head 1 starts printing while rotating the rollers 5 and 6 in directions of arrows 5A and 6A, respectively.

Since the validation sheet is of a fixed size, its print starting position is determined when it is set. Upon start of printing, the validation sheet 13 is forwarded in a direction of arrow 13B.

Both types of recording sheet have one of their ends forwarded upward to pass through the recording sheet detector 26, and the presence of either recording sheet is thus detected when the end departs from the optical axis 26*a*, that is, when the optical axis 26*a* is unblocked. Since the printing region immediately after the detection of the end is equal in length to the remaining recording sheet path length, the printing limit is determined by calculating the remaining length using a CPU-based control unit thereby to properly print within a predetermined region.

Figure 6A:
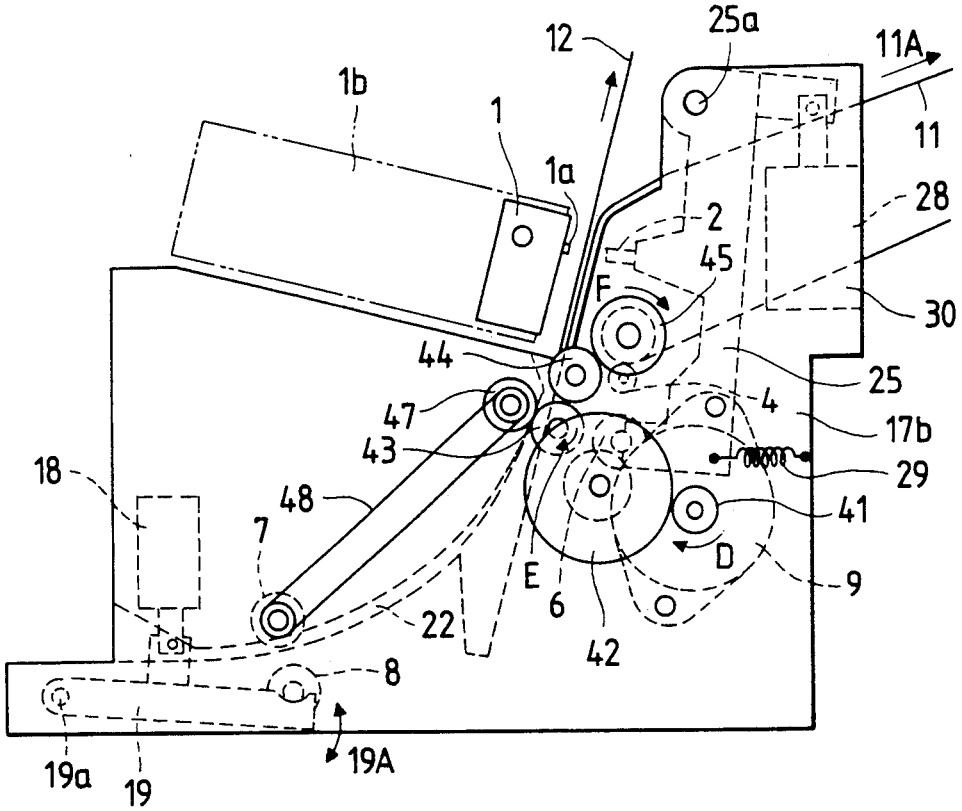
FIGS. 6(*a*) and 6(*b*) and FIGS. 7(*a*) and 7(*b*) are diagrams for explaining an embodiment of the mechanism section of the printer according to the invention, of which FIGS. 6(*a*) and 6(*b*) are schematic diagrams showing the connection between respective recording sheet forwarding mechanisms and a motor, and FIGS. 7(*a*) and 7(*b*) are diagrams showing the state of setting a rolled sheet and a slip sheet in respective recording positions.
Figure 6B:
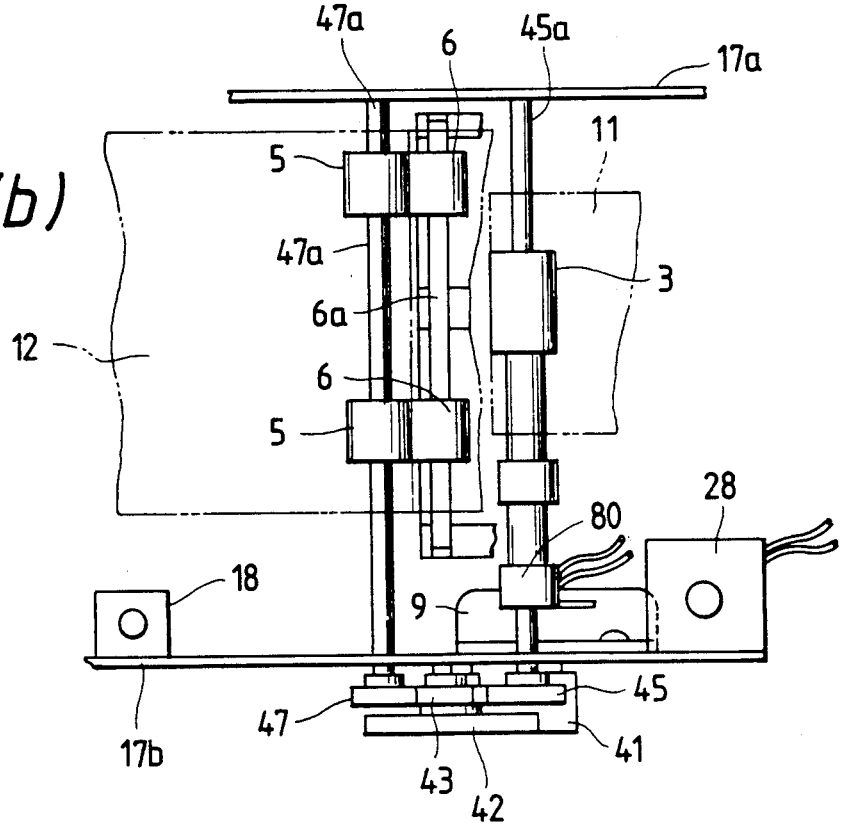
Figure 7A:
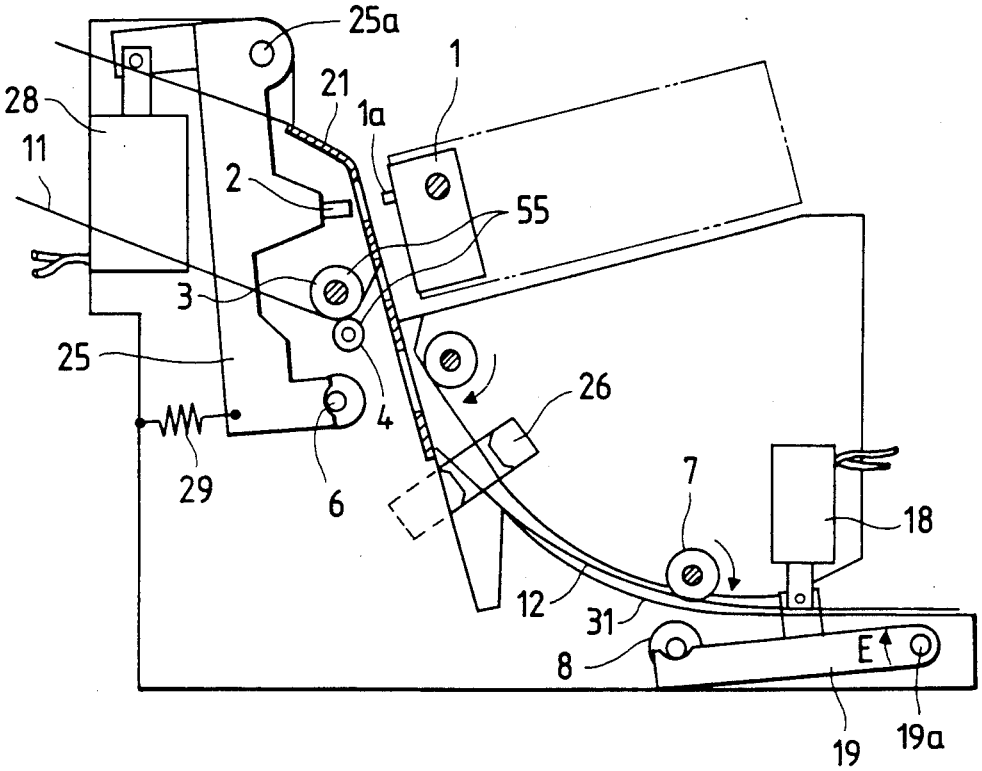
Figure 7B:
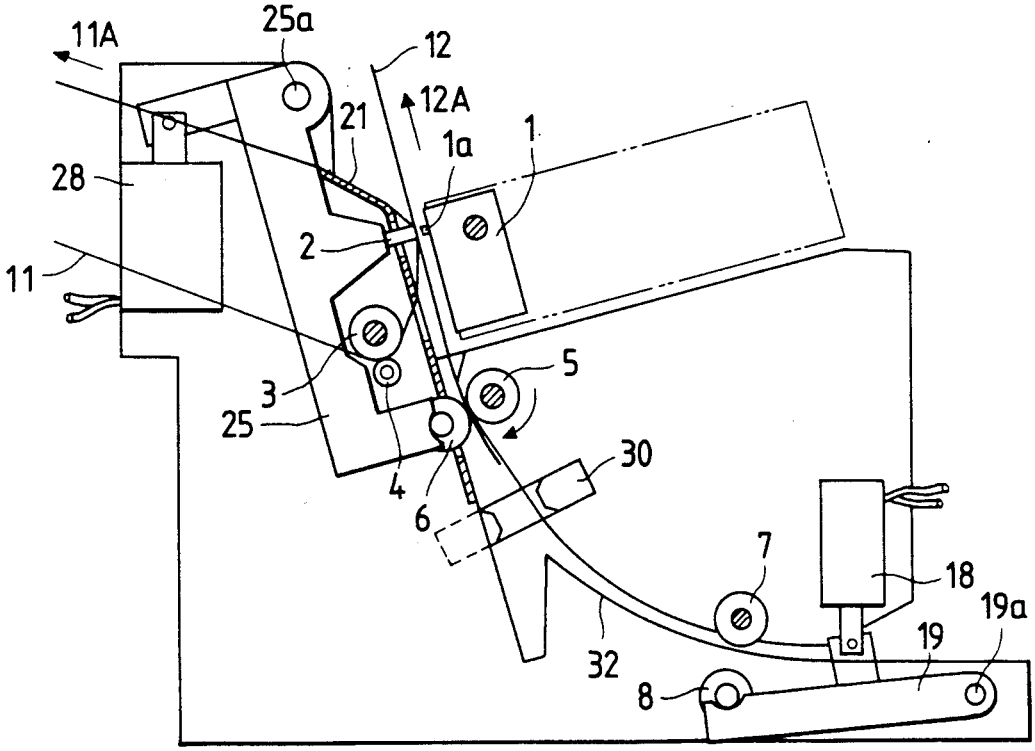

FIGS. 6(*a*) and 6(*b*) and FIGS. 7(*a*) and 7(*b*) are diagrams for explaining an embodiment of a mechanism section of the printer according to the invention. This mechanism section includes an additional print mechanism for continuous sheet printing in the mechanism section shown in FIGS. 4(*a*) and 4(*b*) and FIGS. 5(*a*) and 5(*b*). Like reference numerals and characters designate like functions, parts, and components in FIGS. 4(*a*) and 4(*b*) and FIGS. 5(*a*) and 5(*b*).

FIGS. 6(*a*) and 6(*b*) are schematic diagrams showing the connection between each recording sheet forwarding mechanism and the motor. FIG. 7 is a diagram showing the state in which a rolled sheet and a slip sheet are set to their recording positions, while FIG. 7(*b*) is a schematic diagram showing the state where both sheets are being printed.

A stepper motor 9 serving as a sheet forwarding drive source is mounted inside the side frame 17*b* (right side of the printer as viewed from the front), and a motor gear 41 fixed on the shaft of motor 9 is engaged with the train of wheels arrayed outside the side frame 17*b*. Intermediate gears 42, 43, and 44 are rotatably supported by a shaft (not shown) fixed on the side frame 17*b*. A drive gear 45 is fixed on a drive gear shaft 45*a* which is rotatably supported by the side frames 17*a* and 17*b* (left and right of the printer when viewed from the front). A drive gear 47 and the drive rollers 5 are fixed on a gear shaft 47*a*. While the number of the drive rollers 5 and biasing rollers 6 are respectively two in this embodiment, the number may be less or more than two depending on their sheet forwarding capacity. The stepper motor 9, the intermediate gears 42, 43, and drive gear 47, the drive rollers 5, the biasing rollers 6, and the like constitute a recording sheet forwarding mechanism for slip sheets in a manner similar to that shown in FIGS. 4(*a*) and 4(*b*).

In this embodiment, the slip sheet 12 is forwarded while interposed between the biasing rollers 6 and the drive rollers 5, with the intermediate gear 43 and the drive gear 47 connected to the motor 9 and the recording sheet drive roller 7 connected to the drive gear 47 through a belt 48. Since the construction of the plungers 18, 28 and of each recording sheet forwarding mechanism is the same as that shown in FIGS. 4(*a*) and 4(*b*) and FIGS. 5(*a*) and 5(*b*), a further description thereof will be omitted. Reference numeral 29 designates a coil spring that assists the operation of the plunger 28. This coil spring 29 is arranged so that the printing section can be kept open when the coil spring 29 is not energized.

The construction of the mechanism section up to this point is basically the same as that shown in FIGS. 4(*a*) and 4(*b*).

The recording sheet forwarding mechanism for a roller sheet 11, which is a continuous sheet, will now be described.

Reference numeral 45 indicates a drive gear for forwarding the rolled sheet 11. A clutch mechanism is interposed between this gear 45 and the drive roller 3.

Figure 8:
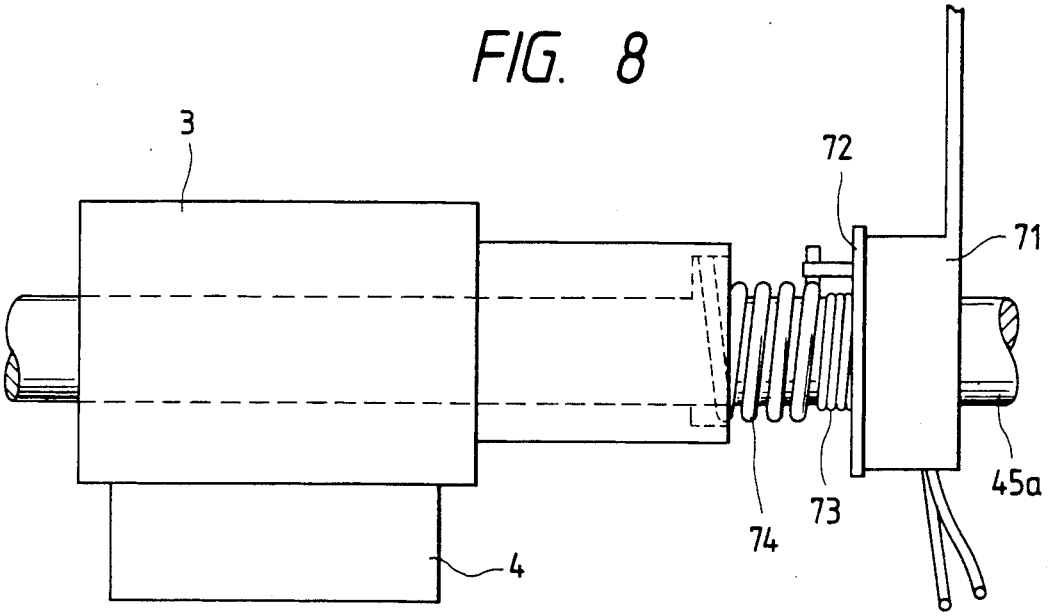
FIG. 8 is a diagram showing in detail a clutch portion of an electrically driven clutch structure.

FIG. 8 is a diagram showing the details of an electrically driven clutch 80 portion, which is one type of clutch mechanism which can be used with the invention.

The clutch 80 is coaxially disposed on the gear shaft 45*a* and serves to bring a clutch plate 72 to a halt with respect to internal members such as the frame 17*b*. That is, a clutch electromagnet 71 is energized to attract and fix at an arbitrary position the clutch plate 72 that has been stably biased on the clutch electromagnet 71 by a compression spring 73 so that the clutch plate 72 will be stopped with respect to, e.g., the frame 17*b*. When the stepper motor 9 is activated under this condition, a clutch spring 74 is rotated as the gear shaft 45*a* rotates. However, since the clutch plate 72 that is held on the loosening side of the clutch spring 74 is stopped with respect to the frame 17*b*, the clutch spring 74 starts to be loosened from the clutch plate 72 side, and as a result the drive force of the gear shaft 45*a* is no longer transmitted to the recording sheet drive roller 3, thereby keeping the drive roller 3 stopped. On the other hand, when the clutch electromagnet 71 is not energized, the clutch plate 72 is not fixed by attraction, and as a result the clutch plate 72 remains rotatable. Since the clutch spring 74 is arranged on the tightening side with respect to the gear shaft 45*a*, the gear shaft 45*a* is engaged with an end of the clutch spring 74 to cause the drive roller 3 to rotate so that the drive force will be transmitted. A biasing roller 4 is 15 biased on the drive roller 3 side at a proper pressure to clamp the rolled sheet 11.

The rolled sheet 11, as shown in FIG. 6(*a*), is discharged to the outside, passing through the inner side of the arm 25, the drive roller 3, and the sheet guide 21, starting from a rolled sheet supply section (not shown). The print head 1 serving as a printing section for both slip and validation sheets as well as rolled sheets contains wire pins 1*a* therein to allow the rolled sheet 11, the slip sheet 12, or the validation sheet 13 to be set within a clearance formed between itself and the platen 2 so that these sheets can be printed using the ink ribbon 1*b*.

The operation of this embodiment will now be described.

(1) Rolled sheet printing

A rolled sheet 11 wound around the drive roller 3 is set within the clearance between the platen 2 and the print head 1, and under this condition the plunger 28 is energized to make the printer ready for printing. Next, the clutch 80 is connected; the drive force of the stepper motor 9 is converted to the rotary force of the drive roller 3 in a direction of 10 arrow 3A to forward the rolled sheet 11; and printing is performed on the rolled sheet 11 in synchronism with the drive timing of the print head 1. In this case, since the slip sheet 12 is not set, the drive rollers 5 and the biasing rollers 6 rotate idly, which does not disturb the rolled sheet printing in any manner.

To use the printer as a receipt issuing machine, the printed rolled sheet must be cut to a proper length by a cutter disposed at an end portion (not shown) in a direction of arrow 11A (FIG. 7(*a*)).

To use the printer as a journal printing machine, the printed rolled sheet must be rewound by rewinding means disposed at a position extending in the direction of arrow 11A so that the printed rolled sheet can be preserved.

(2) Slip sheet printing

The printer is initialized in the following manner. As shown in FIG. 6(*a*), a slip sheet 12 is positioned by a foam stopper (not shown) with the biasing roller 8 opened; the plunger 18 is energized by a sheet presence signal issued when the optical axis of the recording sheet detector 26 is blocked; the motor 9 is then driven. As a result, the slip sheet 12 is interposed between the drive roller 7 and the biasing roller 8, and is forwarded along the sheet guide 21 to a position where its head end is past the printing section, which is opened. The slip sheet 12 is then ready to be printed.

When the plunger 28 is energized, the printing section is closed and the platen 2 is set to a predetermined position so as to be ready for printing, as shown in FIG. 5(*b*). Then, the clutch 80 is disconnected so that the drive force of the stepper motor 9 will not be transmitted to the drive roller 3, and only the slip sheet 12 will be forwarded in a direction of arrow 12A in synchronism with the drive timing of the print head 1 by the drive roller 7, the biasing roller 8, the drive rollers 5, and the biasing rollers 6. As a result, printing is performed on the slip sheet 12. In this case, if a rolled sheet 11 (thermal paper) is also set, the rolled sheet 11 will be printed. However, the rolled sheet 11 will not be forwarded, so that the printed content on the sheet 11 is unintelligible.

(3) Validation sheet printing

The printer is initialized in the following manner. As shown in FIG. 6(*a*), a validation sheet 13 is set with the biasing roller 8 closed and a sheet presence signal is issued when the optical axis of the recording sheet detector 26 has been blocked. The validation sheet 13 is then ready to be printed.

When the plunger 28 is energized, the printing section is closed and the platen 2 is set to a predetermined position, making the printer ready to print, as shown in FIG. 5(*b*). Then, the clutch 80 is disconnected so that the drive force of the stepper motor 9 will not be transmitted to the drive roller 3 and only the validation sheet 13 will be forwarded in the direction of arrow 12A in synchronism with the drive timing of the print head 1 by the drive rollers 5 and the biasing rollers 6. As a result, printing is performed on the validation sheet 13.

(4) Cut sheet and rolled sheet simultaneous printing

To print on both a cut sheet and a rolled sheet simultaneously (security slip mode), the rolled sheet (thermal paper) 11 is set and the clutch 80 is connected in a manner similar to that for the journal printer. Then, the slip sheet 12 is set. The slip sheet 11 is printed over the rolled sheet 12 at the printing section simultaneously with the former through the ink ribbon and the latter by being pressed by the wire pins 1*a*. Since both sheets are forwarded by an equal amount, there will result no misalignment between the two sheets nor any like defect.

Figure 9:
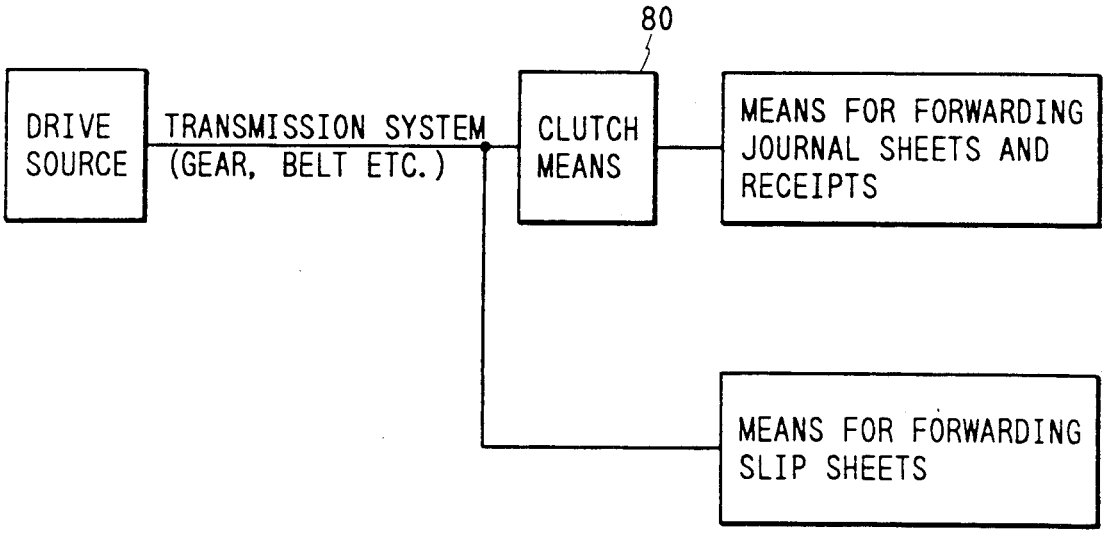
FIG. 9 is a block diagram showing the construction of the mechanism section of the printer according to the invention.

FIG. 9 is a block diagram showing the construction of the mechanism section of the printer according to the invention. The mechanism for forwarding cut sheets such as slip sheets and validation sheets is connected not only to the drive source but also connected to continuous sheets such as rolled sheets and journal sheets through clutch means at all times. Since the clutch mechanism used in the invention is of the electrically driven type, it is possible to select the method of forwarding the recording sheets in response to a command from a print mode instructing device, which is a particular advantage of the invention.

FIG. 1 is a block diagram showing the general construction of the control systems of the invention. Reference numeral 100 designates the mechanism section of the printer described in FIGS. 4(*a*) and 4(*b*) and FIGS. 5(*a*) and 5(*b*) and includes a print head 101, a printing section opening/closing mechanism also serving as a sheet forwarding section opening/closing mechanism 102, a sheet forwarding section opening/closing mechanism also serving as a recording sheet forwarding path blocking mechanism 103, a motor 104 serving as a drive source for forwarding recording sheets, a recording sheet detector 105, and a clutch 106. Reference numeral 60 designates a CPU including a read only memory (ROM) 61, a random access memory (RAM) 62, an interface 63, a print head control circuit 65, plunger control circuits 66 and 67, a motor control circuit 68, a detection circuit 69 connected to the recording sheet detector 105 for detecting the presence of a recording sheet, and a clutch control circuit 70. Reference numeral 64 designates a print mode selector switch for selecting a print mode. The state of the switch indicates whether the selected print mode is slip sheet printing or validation sheet printing.

Upon input of print data from the interface 63, the print data is temporarily written to the RAM 62. Then, the CPU 60 analyzes the print data, reads character font data corresponding to the print data from the ROM 61, and controls the mechanism section of the printer through the motor control circuit 68, the head control circuit 65, and the plunger control circuits 66, 67 thereby to start printing.

The print mode may also be selected by operating a panel switch that is extended from the circuit board to the printer case or through a date code entered from the interface 63. Generally, selection of the recording sheet type through a data code, i.e., a command, is convenient for POS printers connected to a host computer.

Figure 2:
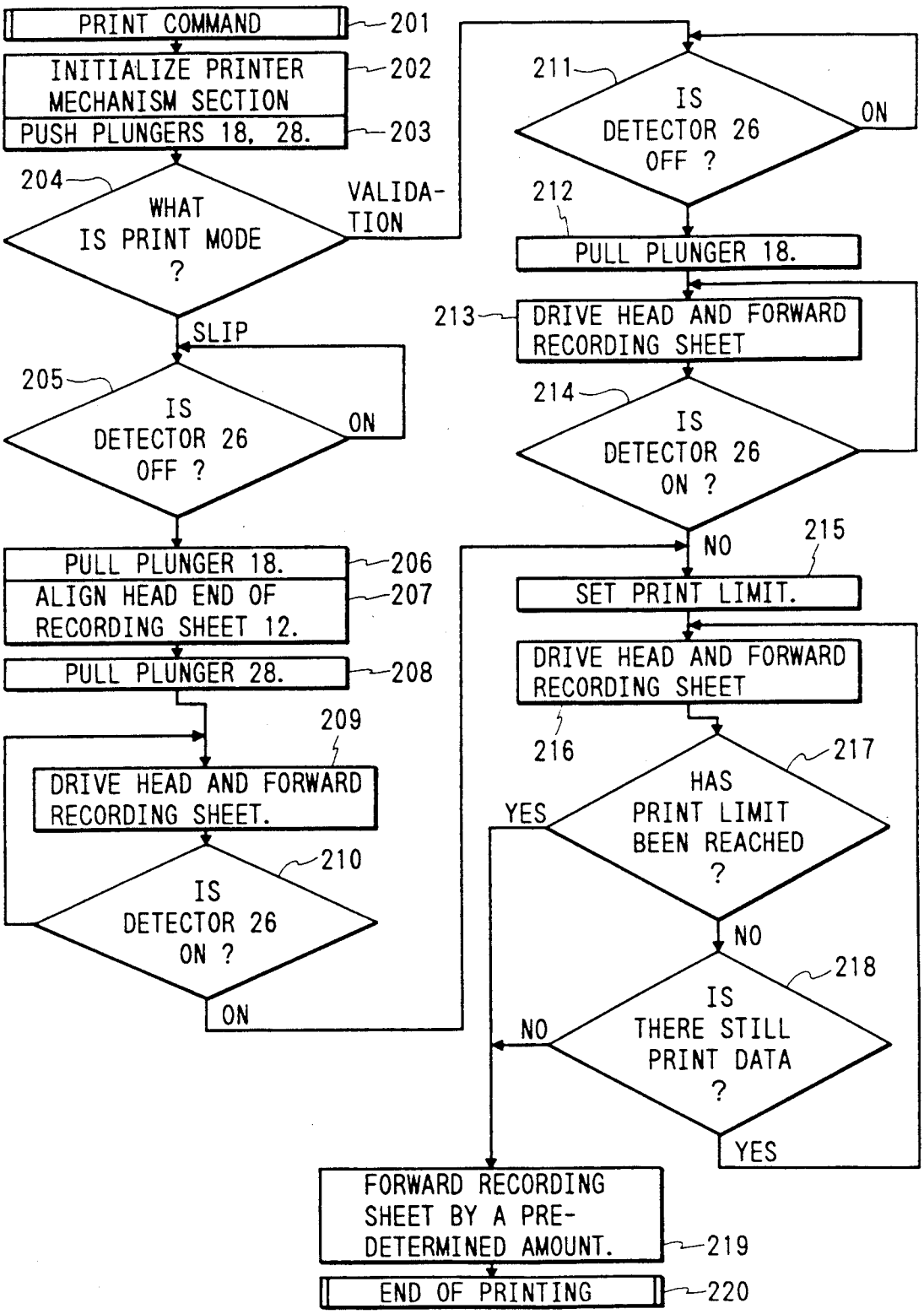
FIG. 2 is a flow chart illustrating a method of controlling a printer according to the invention.

FIG. 2 is a flow chart showing a method of controlling the printer of the invention for cut sheet printing.

Upon receipt of a print command, the print data is written to the RAM 62 (Step 201). Then, the mechanism section of the printer is initialized (Step 202) and the plungers 18, 28 are set in their extended (pushing) state, thereby freeing both the printing section and the recording sheet forwarding path (Step 203). The print mode, i.e., the recording sheet type, is selected (Step 204). For ordinary slip sheets, the print mode is set to a slip mode, and for validation sheets, the print mode is set to a validation mode (Step 205).

In the slip mode, the level of the detector 26 is checked to confirm that the recording sheet has been set, and the printer waits until the detector 26 turns off. After the detector 26 has been turned off, the plunger 18 is set in a retracted (pulling) state and the foam stopper 27, which blocks the recording sheet forwarding path, is made ready to forward the recording sheet 12 (Step 206). The recording sheet 12 is forwarded to the printing section and the sheet head is aligned (Step 207). Then, the plunger 28 is set in its retracted (pulling) state to make the printer ready for printing by closing the printing section (Step 208). While driving the print head 1 and forwarding the recording sheet 12 (Step 209), the position at which the tail end of the recording sheet 12 passes through the detector 26 is monitored (Step 210). When the detector 26 has been turned on, a recording sheet forwarding amount up to the print limit is stored at a predetermined address in the RAM 62, and the recording sheet 12 is forwarded and the print head 1 is driven, both continuously, until the print data ends or the print limit is reached while decrementing the sheet forwarding amount in synchronism with the recording sheet forwarding operation (Steps 216, 217, and 218). After the recording sheet 12 has been forwarded by a predetermined amount (Step 219), the printing operation is brought to an end (Step 220).

In the validation mode, the recording sheet 13 is similarly set (Step 211) and the plunger 18 is set in a retracted (pulling) state (Step 212). Sheet head alignment is not necessary for validation sheets, and the recording sheet 13 must be forwarded only by an amount required by a recording sheet forwarding code included in the print data. The recording sheet 13 is forwarded and the print head 1 is driven, both continuously, until the detector 26 is turned on (Steps 213 and 214). The same operation as that in the slip mode then follows.

Figure 3:
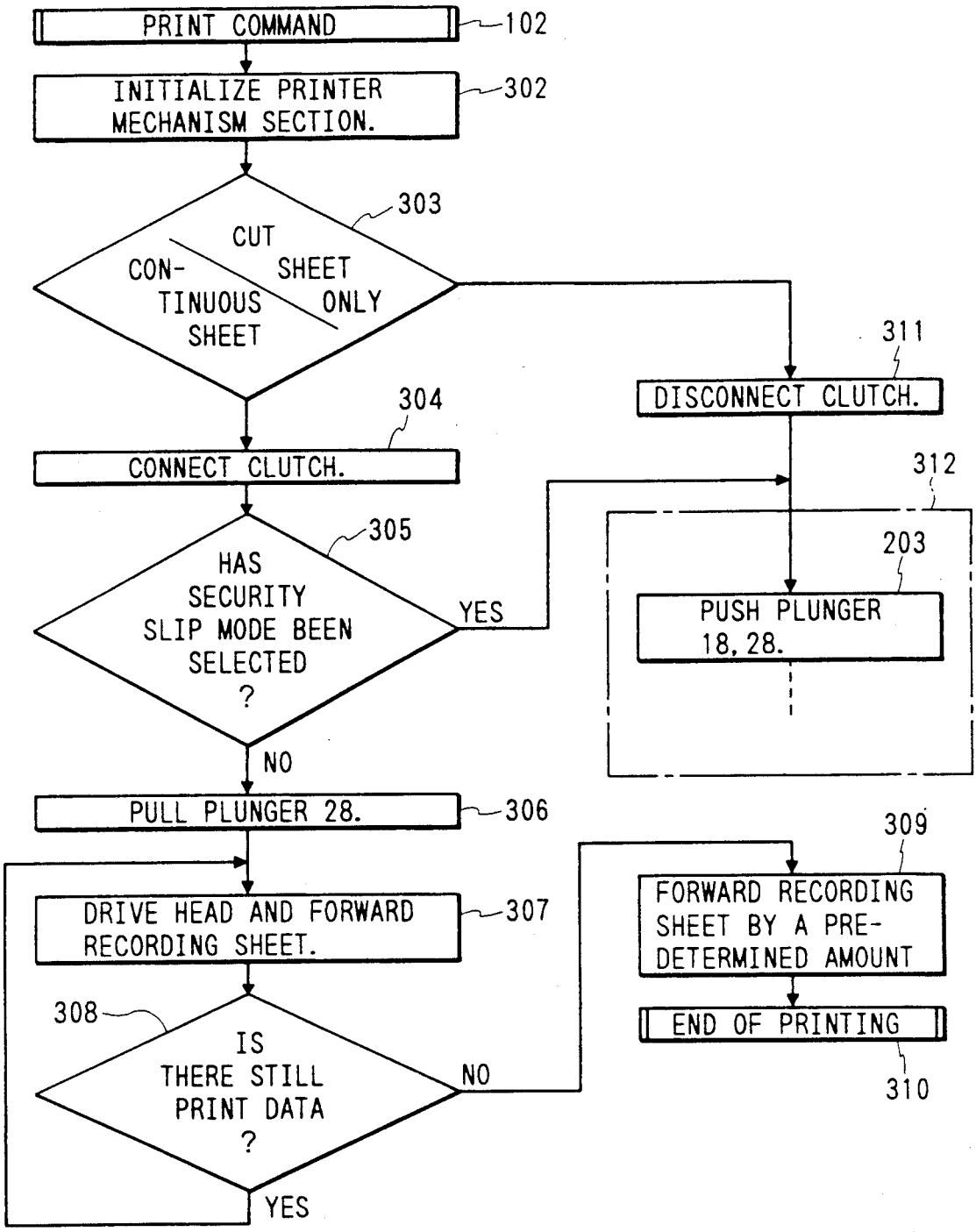
FIG. 3 is a flow chart illustrating another method of controlling the printer according to the invention.

FIG. 3 is a flow chart showing a method of controlling the printer of the invention for rolled sheet printing.

Upon receipt of a print command, the print data is written to the RAM 62 (Step 301). Then, the mechanism section of the printer is initialized (Step 302), and the print mode, i.e., cut sheet printing or continuous sheet printing, is selected (Step 303). For cut sheet printing, the clutch means is disconnected so that the rolled sheet forwarding mechanism will also be disconnected and the cut sheet printing routine shown in Step 312 is executed by causing the CPU to jump to Step 202 in FIG. 2.

For continuous sheet printing, the clutch is connected (Step 304), and it is judged whether the security slip mode is selected (Step 305). If the security slip mode is selected, the cut sheet printing routine 313 is executed (Step 311). For printing only on the rolled sheet, the plunger 28 is put in a retracted (pulling) state (Step 306) to close the printing section, and Steps 307 and 308 are executed for printing. Upon completion of the printing operation, the recording sheet is forwarded (Step 309) and the printing operation is brought to an end (Step 310).

According to these methods, a single printer can meet any printing need in the POS market.

FIG. 10(*b*) is shows the appearance of the mechanism section of the printer according to the invention. To allow an irregular size sheet such as a slip sheet to be printed, a notch section 32 is provided on the left side of the side frame so that the recording sheet, even if protruded from the left side, can be printed. Similarly, a notch section is provided at the side frame for validation sheets so that the validation sheets can be set from the side. Reference numeral 90 designates a rolled sheet holder, which is disposed so as to allow the rolled sheet to be smoothly applied to the mechanism section of the printer.

While a printer having a shuttle type print head is described in the above embodiments as an example, it goes without saying that the printer using a serial print head with an array of seven-pin or nine-pin print elements may obtain the same advantages.

According to the invention, the three recording sheet forwarding paths sharing the single printing section allows a single printer to accommodate various POS printing needs.

Further according to the invention, the three recording sheet forwarding paths sharing the single printing section allows a single printer to accommodate various POS printing needs.

According to the invention, a printer capable of printing in both the slip sheet printing mode in which irregular size slip sheets can be printed and the validation sheet printing mode in which the fixed size validation sheets can be printed is provided. This printer can be made of compact design and high performance.

As a result of the invention, the printer can print on both a cut sheet and a rolled sheet simultaneously, thereby meeting the need for "security" printing for data preservation.

With the construction of the mechanism section and control means of the printer, printing is interrupted when a slip sheet has been erroneously inserted for validation printing by the intervention of the recording sheet blocking mechanism. When the slip mode has been selected, printing on an erroneously inserted validation sheet is likewise interrupted because the tail end of the validation sheet is detected during sheet head alignment. Thus, the invention, allowing a single detector to detect various types of sheets, is very advantageous also in terms of cost.

According to the invention, the construction which allows the printing section to be opened so that a recording sheet can be inserted from the top of the printing section allows multiple type copying sheets to be handled without damage, thereby ensuring proper printing.

In addition, sharing of the drive source by the recording sheet forwarding path blocking mechanism and the sheet forwarding section opening/closing mechanism or by the printing section opening/closing mechanism with other sheet forwarding section opening/closing mechanisms contributes to providing a printer that is extremely simple in structure and inexpensive.

What is claimed is:

1. A printer capable of printing at least two types of recording sheet at a printing section thereof having a print head, comprising:

a print head and a platen confronting said print head;

a first recording sheet forwarding path for a first recording sheet to be printed by being inserted from below said printing section or from an inlet side thereof in a recording sheet forwarding direction;

a second recording sheet forwarding path for a second recording sheet to be printed by being inserted from above said printing section or from a discharge side thereof in said recording sheet forwarding direction;

an electrically driven printing section opening/closing mechanism for changing a clearance between said print head and said platen confronting said print head;

a first recording sheet forwarding mechanism disposed within said first recording sheet forwarding path;

an electrically driven first sheet forwarding section opening/closing mechanism for opening and closing said first recording sheet forwarding path by biasing and releasing a recording sheet forwarding drive section disposed within said first recording sheet forwarding mechanism toward and from said first recording sheet;

a second recording sheet forwarding mechanism, disposed at a recording sheet path shared in common by both said first and second recording sheets, for forwarding both said first and second recording sheets;

an electrically driven second sheet forwarding section opening/closing mechanism for opening and closing said recording sheet forwarding path by biasing and releasing a recording sheet forwarding drive section disposed within said second recording sheet forwarding mechanism toward and from said first or second recording sheet;

recording sheet detection means, disposed adjacent to a point at which said first and second recording sheet forwarding paths meet, for detecting said first or second recording sheet; and an electrically driven sheet path blocking mechanism for blocking said first or second recording sheet forwarding path, said sheet path blocking mechanism being disposed between said recording sheet detection means and said printing section.

2. The printer according to claim 1, further comprising a drive source shared in common by said first and second recording sheet forwarding mechanisms, said drive source comprising a stepper motor.

3. The printer according to claim 1, wherein said sheet path blocking mechanism is operated integrally with said first sheet forwarding section opening/closing mechanism.

4. The printer according to claim 1, wherein said printing section opening/closing mechanism is operated integrally with said second sheet forwarding section opening/closing mechanism.

5. The printer according to claim 4, further comprising control means for controlling said printing section opening/closing mechanism, said first and second recording sheet forwarding mechanisms, said first and second sheet forwarding section opening/closing mechanisms, and said sheet path blocking mechanism in accordance with the result of detection by said recording sheet detection means.

6. The printer according to claim 2, further comprising:

a third recording sheet forwarding path for a third, continuous type recording sheet, in addition to said first and second recording sheets; and a third recording sheet forwarding mechanism for forwarding said third recording sheet, said third recording sheet mechanism being driven by said drive source driving said first and second recording sheet forwarding mechanisms, and said third recording sheet being printed at said printing section.

7. The printer according to claim 6, further comprising electrically drivable clutch means interposed between said drive source and said third recording sheet forwarding mechanism.

8. A printer capable of printing at least two types of recording sheet at a printing section thereof having a print head, comprising:

a print head and a platen confronting said print head;

a first recording sheet forwarding path for a first recording sheet to be printed by being inserted from below said printing section or from an inlet side thereof in a recording sheet forwarding direction;

a second recording sheet forwarding path for a second recording sheet to be printed by being inserted from above said printing section or from a discharge side thereof in said recording sheet forwarding direction;

an electrically driven printing section opening/closing mechanism for changing a clearance between said print head and said platen confronting said print head;

a first recording sheet forwarding mechanism disposed within said first recording sheet forwarding path;

an electrically driven first sheet forwarding section opening/closing for opening and closing said first recording sheet forwarding path by biasing and releasing a recording sheet forwarding drive section disposed within said first recording sheet forwarding mechanism toward and from said first recording sheet;

a second recording sheet forwarding mechanism, disposed at a recording sheet path shared in common by both said first and second recording sheets, for forwarding both said first and second recording sheets;

an electrically driven second sheet forwarding section opening/closing mechanism for opening and closing said recording sheet forwarding path by biasing and releasing a recording sheet forwarding drive section disposed within said second recording sheet forwarding mechanism toward and from said first or second recording sheet;

recording sheet detection means, disposed adjacent to a point at which said first and second recording sheet forwarding paths meet, for detecting said first or second recording sheet;

an electrically driven sheet path blocking mechanism for blocking said first or second recording sheet forwarding path, said sheet path blocking mechanism being disposed between said recording sheet detection means and said printing section;

print mode selection means for selecting a type of recording sheet; and control means for operating said printing section opening/closing mechanism, said second recording sheet forwarding mechanism, said first and second recording sheet forwarding opening/closing mechanisms, and said sheet path blocking mechanism in accordance with the print mode selected by said print mode selecting means.

9. A printer capable of printing at least two types of recording sheet at a printing section thereof having a print head, comprising:

a print head and a platen confronting said print head;

a first recording sheet forwarding path for a first recording sheet to be printed by being inserted from below said printing section or from an inlet side thereof in a recording sheet forwarding direction;

a second recording sheet forwarding path for a second recording sheet to be printed by being inserted from above said printing section or from a discharge side thereof in said recording sheet forwarding direction;

a third recording sheet forwarding path for a third, continuous type recording sheet, in addition to said first and second recording sheets; and an electrically driven printing section opening/closing mechanism for changing a clearance between said print head and said platen confronting said print head;

a first recording sheet forwarding mechanism disposed within said first recording sheet forwarding path;

an electrically driven first sheet forwarding section opening/closing mechanism for opening and closing said first recording sheet forwarding path by biasing and releasing a recording sheet forwarding drive section disposed within said first recording sheet forwarding mechanism toward and from said first recording sheet;

a second recording sheet forwarding mechanism, disposed at a recording sheet path shared in common by both said first and second recording sheets, for forwarding both said first and second recording sheets;

a drive source shared in common by said first and second recording sheet forwarding mechanisms, said drive source comprising a stepper motor;

a third recording sheet forwarding mechanism for forwarding said third recording sheet, said third recording sheet mechanism being driven by said drive source driving said first and second recording sheet forwarding mechanisms, and said third recording sheet being printed at said printing section;

an electrically driven second sheet forwarding section opening/closing mechanism for opening and closing said recording sheet forwarding path by biasing and releasing a recording sheet forwarding drive section disposed within said second recording sheet forwarding mechanism toward and from said first or second recording sheet;

electrically drivable clutch means interposed between said drive source and said third recording sheet forwarding mechanism;

control means for connecting said clutch means in a slip mode and disconnecting said clutch means in a security mode;

recording sheet detection means, disposed adjacent to a point at which said first and second recording sheet forwarding paths meet, for detecting said first or second recording sheet; and an electrically driven sheet path blocking mechanism for blocking said first or second recording sheet forwarding path, said sheet path blocking mechanism being disposed between said recording sheet detection means and said printing section;

wherein a print mode for printing on said first recording sheet, which is at least a cut sheet, includes said slip mode for printing only on said first recording sheet and said security mode for printing a content identical to that of said first recording sheet on said third recording sheet.

* * * * *